US006915841B2

(12) United States Patent
Campbell et al.

(10) Patent No.: US 6,915,841 B2
(45) Date of Patent: Jul. 12, 2005

(54) FLEXIBLE SIZE AIR CONDITIONER

(75) Inventors: Timothy J. Campbell, Old Hickory, TN (US); Jatin C. Khanpara, LaVergne, TN (US)

(73) Assignee: WhirlPool Corporation, Benton Harbor, MI (US)

( * ) Notice: Subject to any disclaimer, the term of this patent is extended or adjusted under 35 U.S.C. 154(b) by 0 days.

(21) Appl. No.: 10/154,364

(22) Filed: May 23, 2002

(65) Prior Publication Data

US 2003/0217834 A1 Nov. 27, 2003

(51) Int. Cl.[7] ..... F23H 9/06

(52) U.S. Cl. ..... 165/53; 165/54; 165/905; 62/262; 62/298

(58) Field of Search ..... 165/47, 48.1, 53, 165/54, 905; 62/262, 263, 298

(56) References Cited

U.S. PATENT DOCUMENTS

| | | | | | |
|---|---|---|---|---|---|
| 2,891,389 | A | * | 6/1959 | Tull | 62/298 |
| 3,123,987 | A | * | 3/1964 | Moore | 62/263 |
| 3,665,727 | A | * | 5/1972 | Mather | 62/298 X |
| 3,729,950 | A | * | 5/1973 | Astrom | 62/263 X |
| 3,756,039 | A | * | 9/1973 | Riello | 62/262 |
| 3,766,749 | A | * | 10/1973 | Livesay | 62/298 X |
| 3,838,579 | A | * | 10/1974 | Ballard | 62/298 X |
| 3,838,580 | A | * | 10/1974 | Ballard | 62/298 X |
| 3,992,897 | A | * | 11/1976 | Loos | 62/262 |
| 4,051,693 | A | * | 10/1977 | Needham | 62/262 |
| 4,240,264 | A | * | 12/1980 | Nakada et al. | 62/262 X |
| 4,370,863 | A | * | 2/1983 | Fisher | 62/263 X |
| 4,471,633 | A | * | 9/1984 | Tinsler | 62/298 X |
| 4,607,499 | A | * | 8/1986 | Bolton et al. | 62/262 |
| 4,637,222 | A | * | 1/1987 | Fujiwara et al. | 62/298 X |
| 4,637,223 | A | * | 1/1987 | Hosoya et al. | 62/263 |
| 4,641,503 | A | * | 2/1987 | Kobayashi | 62/263 X |
| 4,672,818 | A | * | 6/1987 | Roth | 62/298 X |
| 4,869,075 | A | * | 9/1989 | Ikari et al. | 62/262 X |
| 4,951,737 | A | * | 8/1990 | Tenhundfeld et al. | 62/298 X |
| 5,125,197 | A | * | 6/1992 | Fuchs | 62/262 X |
| 5,125,239 | A | * | 6/1992 | Kobayashi et al. | 62/262 |
| 5,140,830 | A | * | 8/1992 | Sawyer | 62/298 |
| 5,142,883 | A | * | 9/1992 | DeWitt | 62/298 |
| 5,295,531 | A | * | 3/1994 | Tsunekawa et al. | 62/262 X |
| 5,467,610 | A | * | 11/1995 | Bolton et al. | 62/262 |
| 5,638,692 | A | * | 6/1997 | Aizawa et al. | 62/263 X |
| 5,638,693 | A | * | 6/1997 | Baek | 62/298 X |
| 5,676,438 | A | * | 10/1997 | Jeong | 62/262 X |
| 5,943,873 | A | * | 8/1999 | Chung | 62/262 |
| 6,032,478 | A | * | 3/2000 | Da Luz Moreas | 62/262 |
| 6,032,479 | A | * | 3/2000 | Choi et al. | 62/262 |

(Continued)

FOREIGN PATENT DOCUMENTS

| | | | | |
|---|---|---|---|---|
| JP | 54-51236 | * | 4/1979 | 62/262 |
| JP | 63-41744 | * | 2/1988 | 62/262 |

*Primary Examiner*—Ljiljana Ciric
(74) *Attorney, Agent, or Firm*—John F. Colligan; Stephen Krefman; Robert O. Rice

(57) ABSTRACT

A room air conditioner is provided which includes a compressor, a condenser coil, an evaporator coil, a wall positioned between the condenser coil and the evaporator coil, a chassis for supporting said compressor, condenser coil and wall, with the evaporator coil being secured to and supported by the wall, and at least a portion of the evaporator coil extending forwardly of a front edge of the chassis. The chassis is preferably formed of metal while the wall is preferably formed at least partially of plastic, in an upper and a lower mating piece. A plastic front panel may be positioned in front of the evaporator coil and secured to the wall. A series of air conditioners can be provided with a single sized chassis, but differing sized evaporator coils, to provide models with different cooling capacities utilizing a single sized chassis, with smaller cooling capacity air conditioners having a smaller size than larger capacity air conditioners of the series.

23 Claims, 8 Drawing Sheets

U.S. PATENT DOCUMENTS 6,062,034 A * 5/2000 Nakanuma ..... 62/298
6,145,336 A * 11/2000 Miller et al. ..... 62/298
6,182,460 B1 * 2/2001 Hernandez et al. ..... 62/262
6,257,012 B1 * 7/2001 Tesche et al. ..... 62/298
6,330,807 B1 * 12/2001 Correa et al. ..... 62/298 X
6,381,978 B1 * 5/2002 Moretti et al. ..... 62/262
6,460,362 B1 * 10/2002 Oliveira De Barros et al. ..... 62/262
6,604,375 B2 * 8/2003 Kim ..... 62/263 X
6,606,878 B1 * 8/2003 Phillips et al. ..... 62/298 X
2001/0035021 A1 * 11/2001 Kang et al. ..... 62/262
2002/0056282 A1 * 5/2002 An ..... 62/262

* cited by examiner

FLEXIBLE SIZE AIR CONDITIONER

BACKGROUND OF THE INVENTION

The present invention relates to air conditioning appliances and more particularly to a room air conditioner. Room air conditioners are individual units which contain a compressor, a condenser on a back side of the unit and an evaporator on a front side, all carried on a single chassis, with the size of the evaporator varying depending upon the btu/h requirement for the particular air conditioning unit. In the past it has been common to design a single chassis to accommodate the largest sized unit in a series of units, with the smaller units and evaporators being carried on the larger chassis with extra unused space. This has resulted in product costs being chassis dependent and not model dependent.

SUMMARY OF THE INVENTION

The present invention provides for a single size chassis for several different sizes or model units. However, the chassis is designed to carry only the back side components such as the compressor and condenser and the condenser fan and motor. The front side components, primarily the evaporator and user operated controls, will provide a changing size to the front of the unit, thereby providing different sized units for different size of cooling capacity and allowing a smaller "footprint" for smaller size units.

The back part of the unit is fabricated of metal while the front part of the unit can be made by utilizing plastic clam shells and a plastic front panel. Since the front area of the unit is plastic, marketing, manufacturing and engineering functions have the flexibility to change the design of the front of the unit without a complete chassis redesign. Further, evaporator coils can be optimized, and blower wheels and air systems can be easily changed, with only having to re-tool the plastic parts and not the metal parts.

The refrigeration and air systems can be modified by increasing or decreasing the size of the evaporator coil to meet the btu/h requirements. For example, the evaporator coil can be made one row, two row or three rows deep depending upon the cooling capacity for the particular model. The control configuration can also be easily modified with a plastic front.

DETAILED DESCRIPTION OF THE PREFERRED EMBODIMENT

The present invention relates to a air conditioner, such as a room air conditioner which typically is positioned in a window or in a through the wall sleeve such that a front part of the air conditioner unit is positioned in a space to be cooled and a back part is exposed to the exterior of the space. While the present invention can be utilized in many different types of such air conditioning units, it is shown and described in one particular unit, for illustrative purposes, however the scope of the claims should not be limited to the embodiment illustrated and described.

Figure 1:
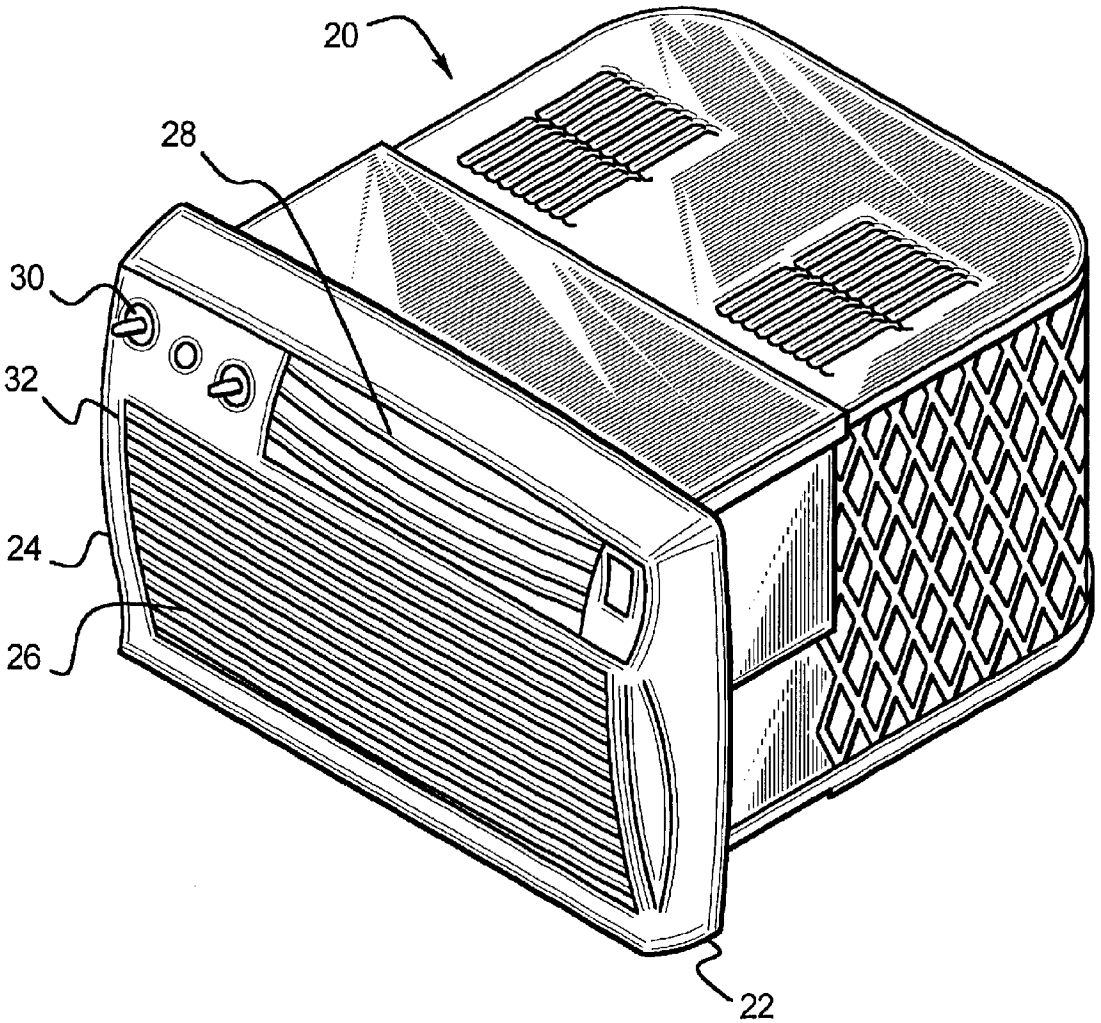
FIG. 1 is a front perspective view of a room air conditioner incorporating the principles of the present invention.

In FIG. 1 there is illustrated a room air conditioner 20 embodying the principles of the present invention which comprises a cabinet portion 22 facing the interior of a space to be cooled, including a front panel 24 with an air flow inlet grill 26 and an air flow outlet grill 28. A plurality of controls 30 are arranged on a control panel 32 located on the front panel 24. Room air is pulled into the air flow inlet grill 26 and discharged back into the room through the air flow outlet grill 28.

Figure 2:
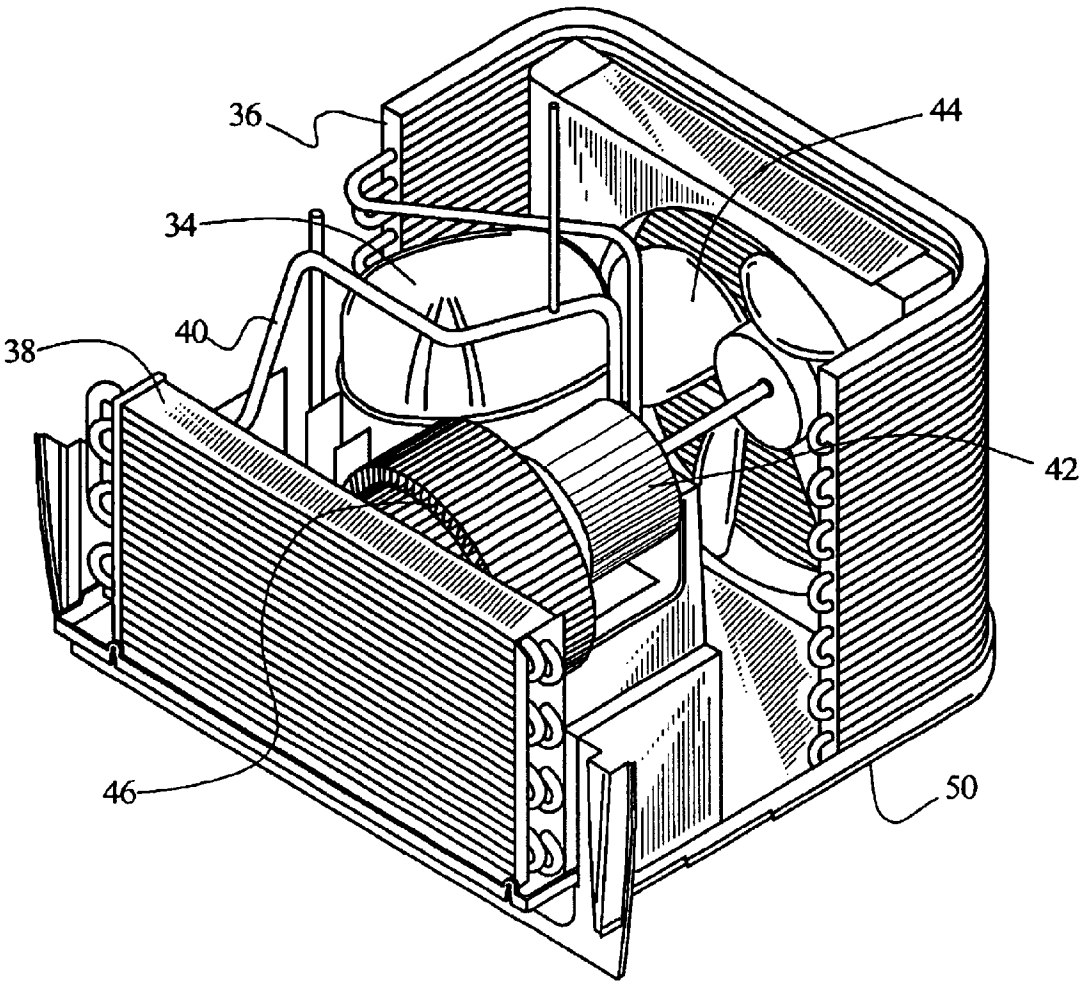
FIG. 2 is a perspective view, partially cut away, of a room air conditioner embodying the principles of the present invention.

In FIG. 2, some of the interior components of the room air conditioner 20 are illustrated including a compressor 34, a condenser coil 36 and an evaporator coil 38, all interconnected by refrigeration lines 40 as is known in the art. A single motor 42 is used to drive a condenser fan 44 and an evaporator blower 46, also as is known.

Figure 3:
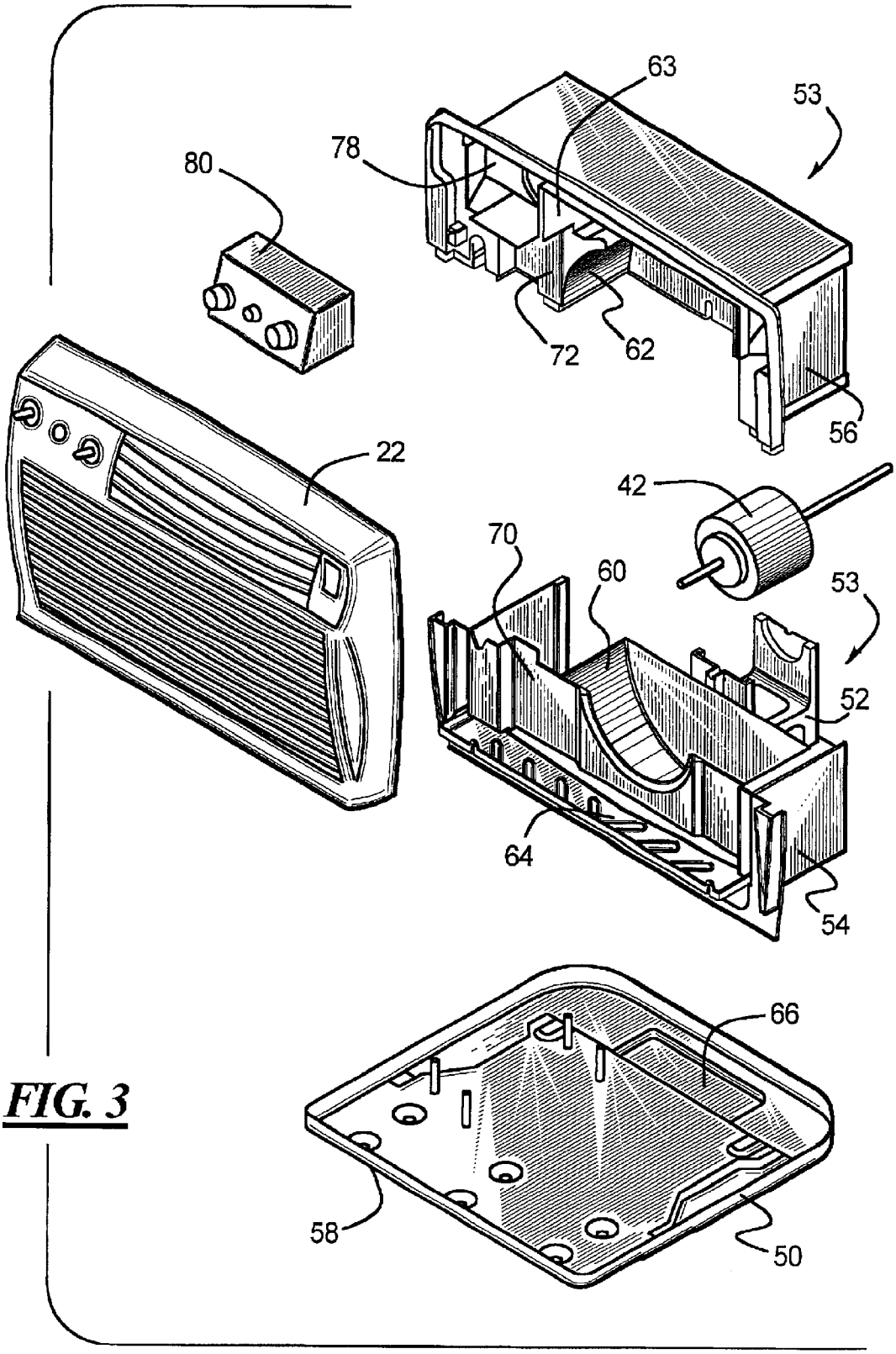
FIG. 3 is an exploded component view of a room air conditioner incorporating the principles of the present invention.

As seen in FIG. 3, a chassis 50 is provided, which preferably is formed of a rigid metal material and is stamped to receive and support various components of the room air conditioner 20 including the compressor 34 and its motor (not shown), the condenser coil 36, a motor mount 52 for the fan and blower motor 42 as well as a separating wall 53 which separates the back or hot side of the room air conditioner from the front or cool side.

Figure 5:
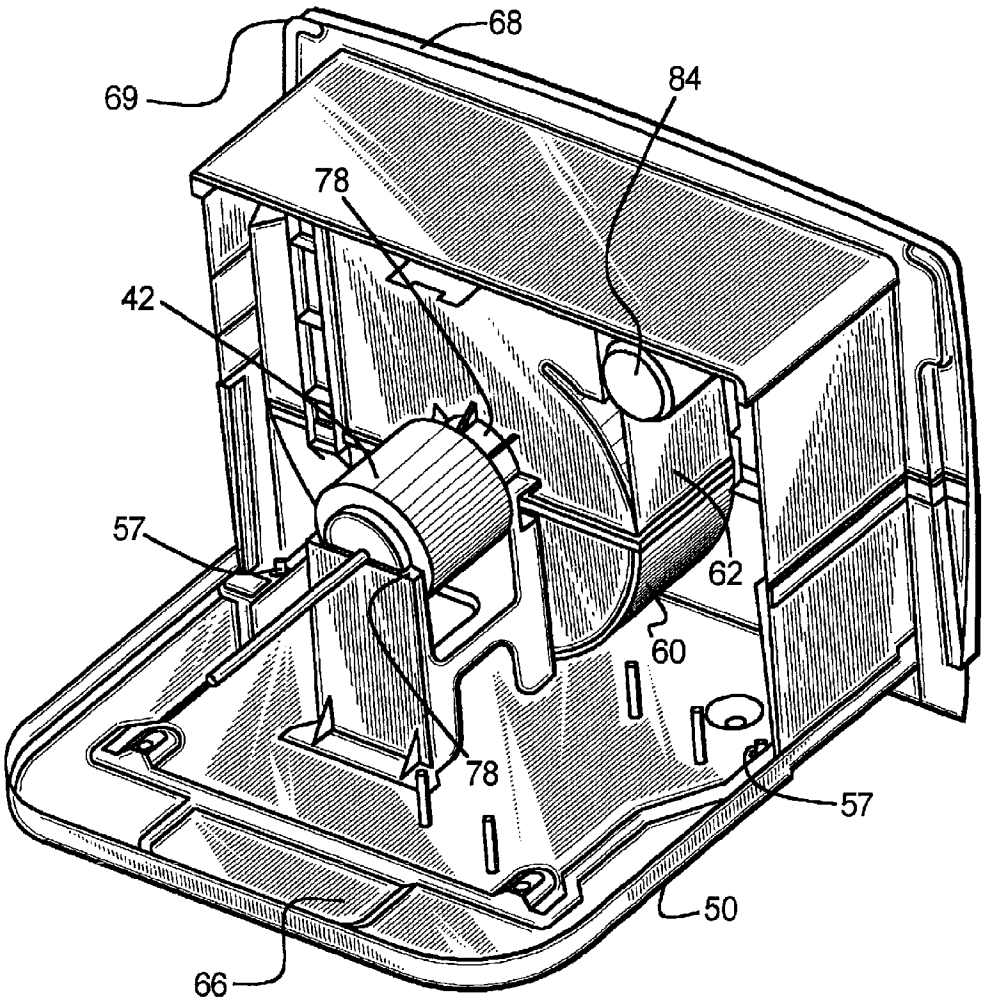
FIG. 5 is a rear perspective view of some of the components of a room air conditioner embodying the principles of the present invention.

In the embodiment illustrated, the separating wall 53 may be formed from a pair of plastic clam shell pieces including a lower clam shell piece 54 and an upper clam shell piece 56 which mate together to provide the separating wall between the front and rear of the room air conditioner 20. The lower clam shell piece 54 can be secured to the chassis 50 by appropriate fastening means 57 (FIG. 5), such as screws or bolts. Thus, all of the major components of the back side of the air conditioner can be secured to the chassis 50.

Figure 6:
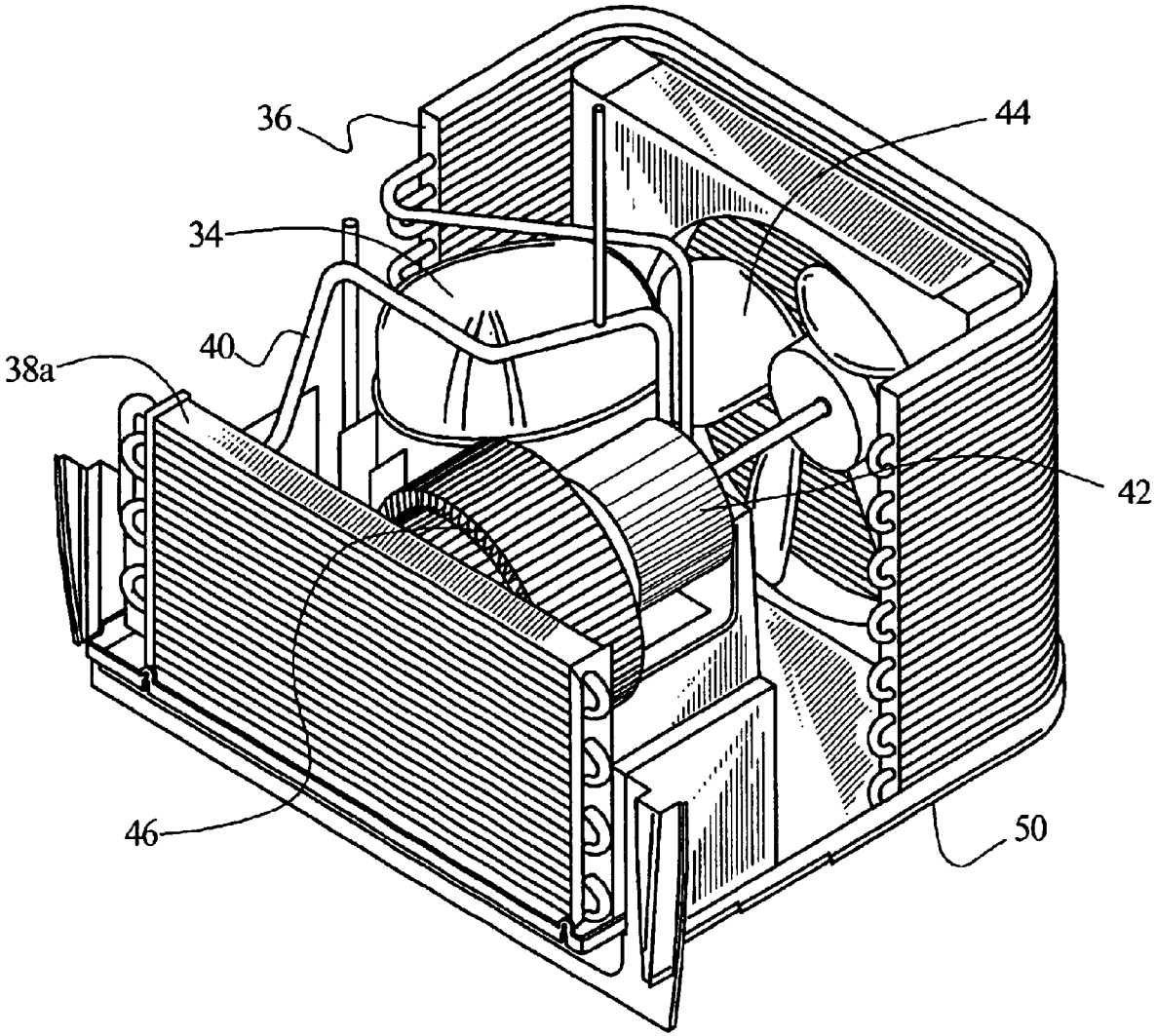
FIG. 6 is a perspective view, partially cut away, of another embodiment of a room air conditioner embodying the principles of the present invention.
Figure 7:
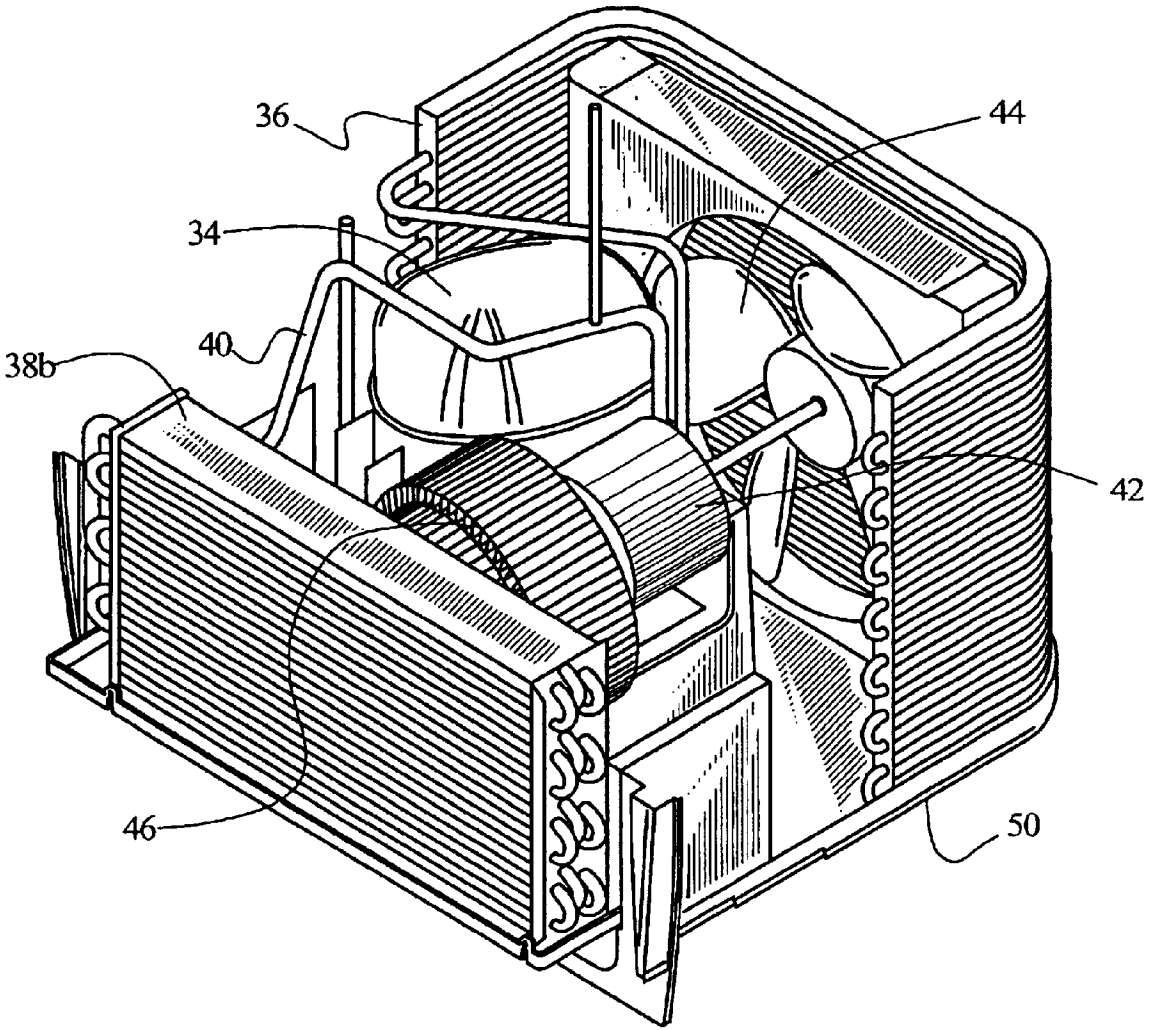
FIG. 7 is a perspective view, partially cut away, of another embodiment of a room air conditioner embodying the principles of the present invention.
Figure 8:
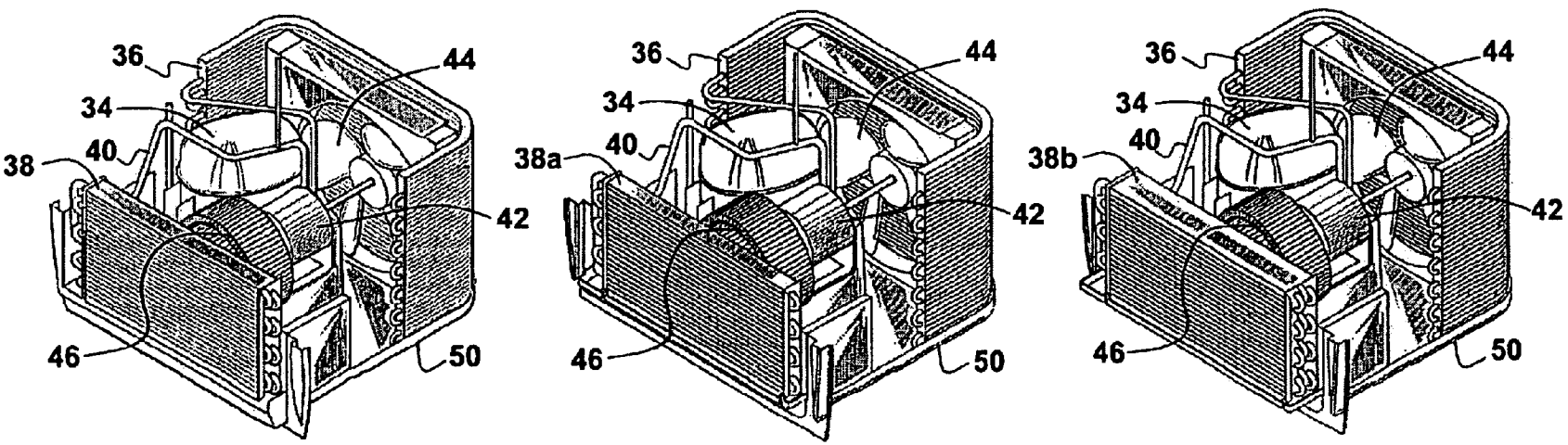
FIG. 8 is a perspective view of a series of room air conditioners illustrated individually in FIGS. 2, 6, and 7, and illustrating evaporator coils having greater front to back dimensions than others in the series.

Typically, in a series of air conditioners, to change the cooling capacity (measured in btu/h) from one model to the next, the evaporator coil 38 is changed in size, with the greater the evaporator coil size, the greater the cooling capacity of the room air conditioner. One way of increasing the size of the evaporator coil 38 is to increase the number of layers or rows of coils which results in changing the front to back thickness of the evaporator coil. The evaporator coil 38 illustrated in FIG. 2 has two rows of coils. FIG. 6 shows the evaporator 38*a* with one front to back row of coils and FIG. 7 shows the evaporator 38*b* with three front to back rows of coils.

The present invention allows for the use of a single sized chassis 50 for several different cooling capacity size room air conditioners of a series, since the evaporator coils 38 are no longer mounted to or supported by the chassis 50 in any direct way, but rather are mounted to and extend forwardly of the separating wall formed by the clam shell pieces 54, 56. The evaporator coil 38 therefore extends forwardly of a front edge 58 (FIG. 3) of the chassis 50. Thus, the front cabinet portion 22 will change in size depending on the cooling capacity of the air conditioner, while the back portion retains a constant size supported by a single sized chassis 50. In this manner, a smaller cooling capacity air conditioner will present a smaller footprint, or space consumption, than a larger capacity room air conditioner in a given series.

Preferably the front cabinet portion 22 is formed of a plastic material which allows the consumer visible portion of the room air conditioner to be changed or modified relatively easily, without requiring any redesign to the chassis 50. By utilizing plastic clam shell pieces 54, 56 as the enclosure for the evaporator blower 46, any changes to the air system relating to the evaporator, including inlets, blower configuration and outlets can also be easily modified without redesigning the chassis.

Modifications to the control panel 32 and controls 30 are also easily modified with the front portion 22 of the room air conditioner 20 being formed of a plastic material which thereby allows the marketing functions, manufacturing functions and engineering functions to have the flexibility to change the design of the visible portion of the room air conditioner without a complete chassis redesign.

Figure 4:
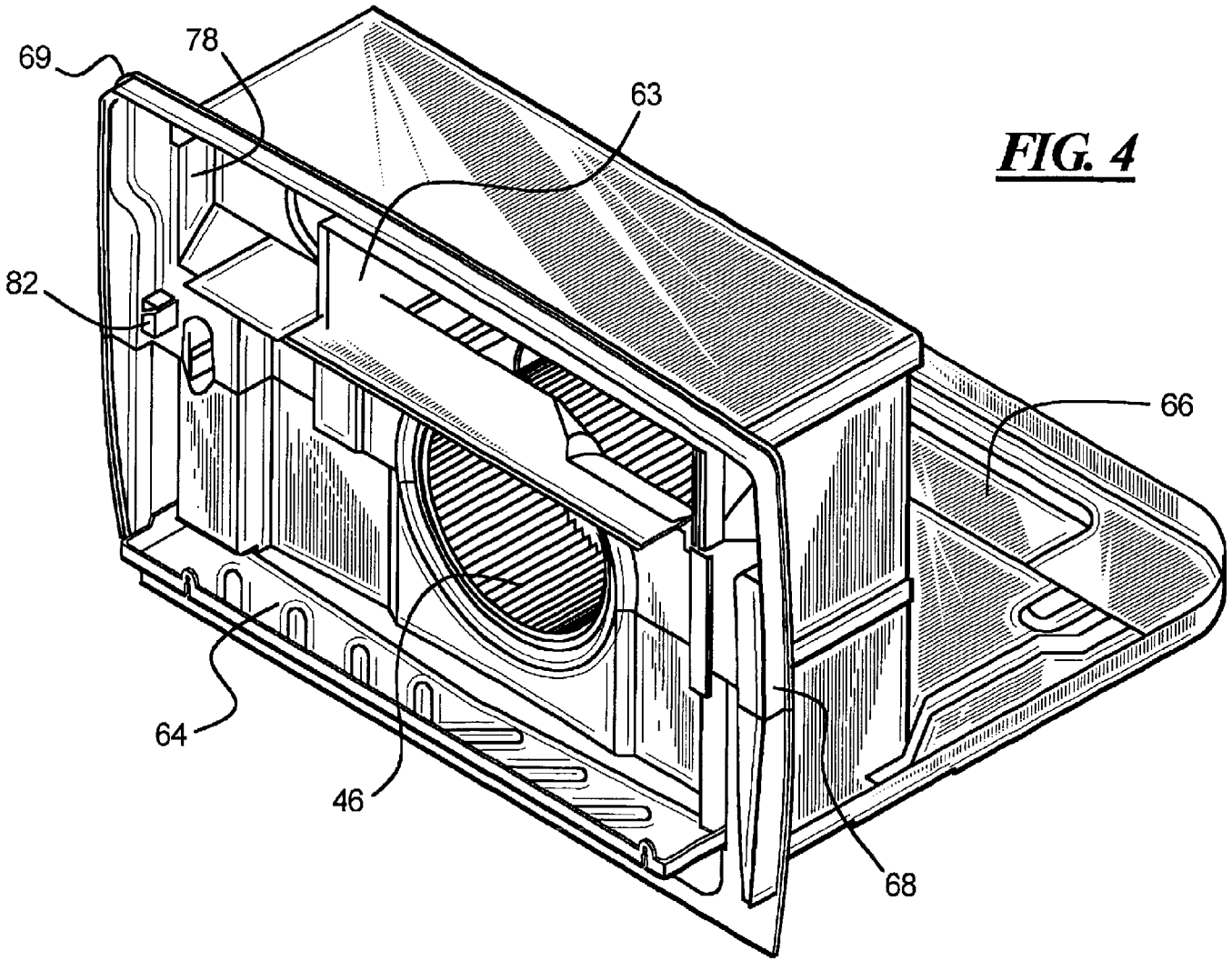
FIG. 4 is a front perspective view of some of the subcomponents of a room air conditioner embodying the principles of the present invention.

The clam shell pieces 54, 56, by being molded plastic parts, can have molded as parts thereof, many components of the roam air conditioner, thereby reducing the number of individual parts and hence the time and cost for assembly of the room air conditioner. Specifically, the clam shell parts include wall portions 60 and 62 (FIG. 3) which form an air housing for the evaporator blower 46 to direct the in flow of air which has passed over the evaporator coil 38 to the air flow outlet grill 28 through an air discharge area 63. The clam shells also form a water collecting pan area or drip pan 64 for receiving condensed water vapor from the evaporator coil 38. This collected water is then drained to the rear of the air conditioner unit, through an appropriate channel, to be dispensed in one of a number of known ways from a sump area 66 formed in the chassis 50. The clam shells 54, 56 also provide an attachment surface for the front portion 22 of the room air conditioner which may include a flange area 68 for mating with a complementary shaped portion of the front cabinet portion 22 which can be secured to the flange by appropriate fastening means, such as screws. A rear edge 69 (FIG. 4) of the flange 68 acts as a positioning feature for the front portion 22, as well as a finishing edge which will be exposed to the exterior of the air conditioner unit when it is fully assembled.

The clam shell pieces 54, 56 include vertical wall elements 70, 72 which may form the divider wall or which may support an additional divider wall between the front side and back side of the room air conditioner.

The lower clam shell piece 54 may incorporate, as a molded portion thereof, the motor mount 52 for receiving and supporting the fan and blower motor 42. Appropriate areas 74 (FIG. 5) can be formed on the motor mount 52 to allow the motor 42 to be secured to the motor mount. Also, the upper clam shell piece 56 can include a motor securing ring 76 to assist in holding the fan and blower motor 42 on the motor mount 52.

An area 78 (FIG. 4) can be molded to the upper clam shell piece 56 for receiving the control unit 80 (FIG. 3) for the controls.

A feature 82 can be molded as a part of the upper clam shell piece 56 to provide a routing for an appliance cord used to connect the electrical components to a source of electrical power. The upper clam shell piece 56 can also have molded thereinto a positioning and receiving area for a large capacitor 84 (FIG. 5) used in the electrical system.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A room air conditioner comprising:

a compressor, a condenser coil, and a motor for driving at least a condenser fan;

a chassis arranged to directly support said compressor and said condenser coil, said chassis having a front edge;

a wall supported by said chassis;

an evaporator coil supported primarily via said wall and extending forwardly of said front edge of said chassis; and a front cabinet portion covering said evaporator coil;

said wall comprising two mating pieces and separating an area containing said evaporator coil from said condenser, and providing an attachment surface for said front cabinet portion.

2. A room air conditioner according to claim 1, wherein said two mating pieces of said wall are formed as an upper piece and a lower piece, with said lower piece secured to said chassis.

3. A room air conditioner according to claim 1, wherein said wall includes a support mount for said motor.

4. A room air conditioner according to claim 1, wherein said wall forms a housing for air passing over said evaporator coil.

5. A room air conditioner according to claim 1, wherein said chassis includes a condensation collection sump.

6. A room air conditioner according to claim 1, wherein said chassis is metal.

7. A room air conditioner according to claim 1, wherein said wall is fabricated from plastic.

8. A room air conditioner according to claim 1, wherein said wall forms a drip pan for said evaporator coil.

9. A series of room air conditioners wherein:

each of said air conditioners has a compressor, an evaporator coil, a front cabinet portion covering said evaporator coil, a condenser coil, a motor for driving at least a condenser fan, a wall and an identically sized chassis for directly supporting said compressor, said condenser coil, and said wall;

said wall separating an area containing said evaporator coil from an area containing said condenser coil and providing an attachment surface for said first cabinet portion;

said evaporator coil being supported primarily via said wall and extending forwardly of a front edge of said chassis; and one of said air conditioners of said series having an evaporator with a greater front to back dimension and a greater cooling capacity than an evaporator of another of said air conditioners of said series, said evaporator of said one air conditioner extending further forward of said chassis than said evaporator of said other air conditioner of said series.

10. A series of room air conditioners according to claim 9, wherein said wall comprises two mating pieces.

11. A series of room air conditioners according to claim 10, wherein said two mating pieces of said wall are formed as an upper piece and a lower piece, with said lower piece secured to said chassis.

12. A series of room air conditioners according to claim 9, wherein said wall includes a support mount for said motor.

13. A series of room air conditioners according to claim 9, wherein said wall forms a housing for air passing over said evaporator coil.

14. A series of room air conditioners according to claim 9, wherein said chassis is metal.

15. A series of room air conditioners according to claim 9, wherein said wall is fabricated from plastic.

16. A series of room air conditioners according to claim 9, wherein said wall forms a drip pan for said evaporator coil.

17. A room air conditioner comprising:

a compressor;

a condenser coil;

an evaporator coil;

a wall comprising an upper piece and a lower mating piece, formed at least partially of plastic, and positioned between said condenser coil and said evaporator coil;

a metal chassis for supporting said compressor, said condenser coil and said wall; and a plastic front panel positioned in front of said evaporator coil and secured to said wall;

said evaporator coil being secured to and supported by said wall, and at least a portion of said evaporator coil extending forwardly of a front edge of said metal chassis.

18. A room air conditioner according to claim 17, wherein said wall includes a support mount for said motor.

19. A room air conditioner according to claim 17, wherein said wall forms a housing for air passing over said evaporator coil.

20. A room air conditioner comprising:

a compressor, a condenser coil and a motor for driving at least an evaporator blower;

a chassis arranged to directly support said compressor and said condenser coil;

a two piece wall supported by said chassis, said two piece wall forming a housing which completely surrounds said evaporator blower; and an evaporator coil supported primarily via said wall and extending forwardly of a front edge of said chassis;

said wall separating an area containing said evaporator coil from said condenser.

21. A room air conditioner comprising:

a compressor, a condenser coil, and a motor for driving at least a condenser fan;

a chassis arranged to directly support said compressor and said condenser coil, said chassis having a front edge;

a wall supported by said chassis;

an evaporator coil supported primarily via said wall and extending forwardly of said front edge of said chassis; and a front cabinet portion covering said evaporator coil;

said wall separating an area containing said evaporator coil from said condenser, providing an attachment surface for said front cabinet portion, and including a support mount for said motor.

22. A room air conditioning comprising:

a compressor, a condenser coil, and a motor for driving at least a condenser fan;

a chassis arrange directly support said compressor coil, said chassis having a front edge and said chassis including a condensation collection sump;

a wall supported by said chassis;

an evaporated coil supported primarily via said wall and extending forwardly of said front edge of said chassis; and a front cabinet covering said evaporator coil;

said wall separating an area containing said evaporator coil from said condenser and providing an attachment surface for said front cabinet portion.

23. A room air conditioner comprising:

a compressor, a condenser coil, and a motor for driving at least a condenser fan;

a chassis arranged to directly support said compressor and said condenser coil, said chassis having a front edge and said chassis including a condensation collection sump;

a wall supported by said chassis;

an evaporator coil supported primarily via said wall and extending forwardly of said front edge of said chassis; and a front cabinet portion covering said evaporator coil;

said wall separating an area containing said evaporator coil from said condenser and providing an attachment surface for said front cabinet portion, and forming a drip pan for said evaporator coil.

* * * * *